US009593489B2

(12) United States Patent
DeChristofaro et al.

(10) Patent No.: US 9,593,489 B2
(45) Date of Patent: Mar. 14, 2017

(54) TREAD FOR STEEL-PAN STAIRWAYS

(71) Applicant: Progressive Safety Solutions, LLC, Brookfield, OH (US)

(72) Inventors: David M. DeChristofaro, Niles, OH (US); David H. Wilkerson, Niles, OH (US)

(73) Assignee: Progressive Safety Solutions, LLC, Brookfield, OH (US)

( * ) Notice: Subject to any disclaimer, the term of this patent is extended or adjusted under 35 U.S.C. 154(b) by 0 days.

(21) Appl. No.: 15/140,563

(22) Filed: Apr. 28, 2016

(65) Prior Publication Data

US 2016/0326747 A1 Nov. 10, 2016

Related U.S. Application Data

(60) Provisional application No. 62/158,637, filed on May 8, 2015.

(51) Int. Cl.

| | |
|---|---|
| ***E04F 11/17*** | (2006.01) |
| ***E04F 11/112*** | (2006.01) |
| ***E04F 15/02*** | (2006.01) |
| ***E04F 11/108*** | (2006.01) |
| ***E04F 11/104*** | (2006.01) |

(52) U.S. Cl.

CPC ..... *E04F 11/17* (2013.01); *E04F 11/104* (2013.01); *E04F 11/108* (2013.01); *E04F 11/112* (2013.01); *E04F 15/02038* (2013.01); *E04F 15/02172* (2013.01)

(58) Field of Classification Search

CPC ..... E04G 21/30; E04F 11/17; E04F 11/104; E04F 11/108; E04F 2011/1046; E04F 11/112; E04F 15/02038

See application file for complete search history.

(56) References Cited

U.S. PATENT DOCUMENTS

| | | | | | |
|---|---|---|---|---|---|
| 1,674,713 | A * | 6/1928 | Brooks | E04F 11/163 | 15/215 |
| 1,732,933 | A * | 10/1929 | Frazier | E04F 11/17 | 280/169 |
| 3,801,424 | A * | 4/1974 | Robbins, Jr. | E04F 11/16 | 428/167 |
| 3,978,628 | A * | 9/1976 | Turner | E04F 11/025 | 52/183 |
| 5,148,644 | A * | 9/1992 | Weir | E04B 5/12 | 52/105 |

(Continued)

*Primary Examiner* — Andrew J Triggs

(74) *Attorney, Agent, or Firm* — Blank Rome LLP

(57) ABSTRACT

A tread for a steel-pan staircase. The tread includes a lattice structure comprising a top side, a left side, and a right side. The tread further includes a top surface integrally formed on the top side of the lattice structure, a first tongue-and-groove structure disposed on the left side of the lattice structure, and a second tongue-and-groove structure disposed on the right side of the lattice structure. The lattice structure comprises a plurality of lateral members and a plurality of crosswise members. The first tongue-in-groove structure may include a wall descending from the top surface. The second tongue-in-groove structure may include a first wall extending outwardly from the right side of the lattice structure. Extending upwardly from the first wall may be a second wall or a plurality of teeth. The placement of the first and second tongue-in-groove structures may be reversed.

17 Claims, 7 Drawing Sheets

(56) References Cited

U.S. PATENT DOCUMENTS

| | | | | |
|---|---|---|---|---|
| 5,190,799 | A * | 3/1993 | Ellingson, III | E04F 15/10 15/215 |
| 6,115,975 | A * | 9/2000 | Abdollahi | E04F 11/16 52/179 |
| 6,269,591 | B1 * | 8/2001 | Kelly | E06B 1/70 49/482.1 |
| 6,617,009 | B1 * | 9/2003 | Chen | B29C 47/128 428/148 |
| 6,640,501 | B1 * | 11/2003 | Hussey | E04G 21/30 428/77 |
| 6,860,071 | B2 * | 3/2005 | Weaber | B27M 3/04 428/172 |
| 8,316,594 | B2 * | 11/2012 | Thompson | E04F 11/104 52/179 |
| 9,163,365 | B2 * | 10/2015 | Solis | E04F 11/17 |
| 2003/0079421 | A1 * | 5/2003 | Yang | A47G 27/0287 52/179 |
| 2003/0182880 | A1 * | 10/2003 | Weaber | B27M 3/04 52/179 |
| 2004/0020142 | A1 * | 2/2004 | Kress | E04F 11/02 52/185 |
| 2006/0196129 | A1 * | 9/2006 | Lin | E04F 11/1045 52/188 |
| 2006/0230693 | A1 * | 10/2006 | Giordano | E04G 21/30 52/182 |
| 2008/0010916 | A1 * | 1/2008 | Gardner | E04F 11/1045 52/179 |
| 2008/0028699 | A1 * | 2/2008 | Mak | E04F 11/1045 52/179 |
| 2014/0157712 | A1 * | 6/2014 | Wells | E04F 15/02 52/588.1 |

* cited by examiner

TREAD FOR STEEL-PAN STAIRWAYS

CROSS REFERENCE TO RELATED APPLICATION

This application claims the benefit of U.S. Provisional Application No. 62/158,637, entitled "Temporary Tread for Steel-Pan Stairways," filed May 8, 2015, the contents of which are incorporated herein by reference.

FIELD OF THE INVENTION

The present invention relates to a tread for steel-pan stairways and, more specifically, to a tread for tread pans and for landing pans in stairways, which tread interlocks with adjacent like-constructed treads.

BACKGROUND OF THE INVENTION

The current method that is widely used by the construction industry to safeguard steel-pan stairways during the construction of a building is to place pieces of building materials, including lumber, plywood, drywall, etc., in the tread and landing pans to fill the pan voids. This approach is generally unsafe. Furthermore, it may not meet the requirements of the Occupational Safety and Health Administration (OSHA) regulations in 29 CFR 1926.1052(b) because such filler might not cover the entire step, might not be at or above the level of the pan edge, and might not be secured to the metal tread pan or landing pan. Thus, using such filler might not provide for the safety of the stairways as intended by the regulations.

SUMMARY OF THE INVENTION

In accordance with an aspect of the present invention, there is provided a tread for a steel-pan staircase. The tread can be temporary or permanent. The tread includes a lattice structure comprising a top side, a left side, and a right side. The tread further includes a top surface integrally formed on the top side of the lattice structure and a first tongue-and-groove structure disposed on one of the left side and the right side of the lattice structure. The lattice structure comprises a plurality of lateral members and a plurality of crosswise members.

In accordance with another aspect of the present invention, there is provided a tread for a steel-pan staircase. The tread includes a lattice structure comprising a top side, a left side, and a right side. The tread further includes a top surface integrally formed on the top side of the lattice structure, a first tongue-and-groove structure disposed on the left side of the lattice structure, and a second tongue-and-groove structure disposed on the right side of the lattice structure. The lattice structure comprises a plurality of lateral members and a plurality of crosswise members.

BRIEF DESCRIPTION OF THE DRAWINGS

For the purpose of illustration, there are shown in the drawings certain embodiments of the present invention. In the drawings, like numerals indicate like elements throughout. It should be understood that the invention is not limited to the precise arrangements, dimensions, and instruments shown. In the drawings.

DETAILED DESCRIPTION OF THE INVENTION

Figure 1A:
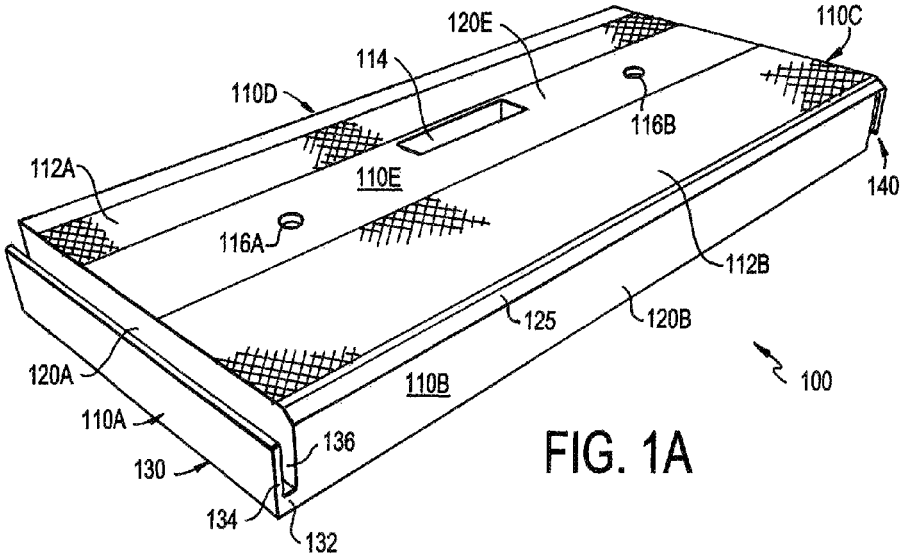
FIG. 1A illustrates a front, top perspective view of an exemplary embodiment of a temporary tread for steel-pan stairways, in accordance with an exemplary embodiment of the present invention.

Reference to the drawings illustrating various views of exemplary embodiments of the present invention is now made. In the drawings and the description of the drawings herein, certain terminology is used for convenience only and is not to be taken as limiting the embodiments of the present invention. Furthermore, in the drawings and the description below, like numerals indicate like elements throughout.

Figure 1B:
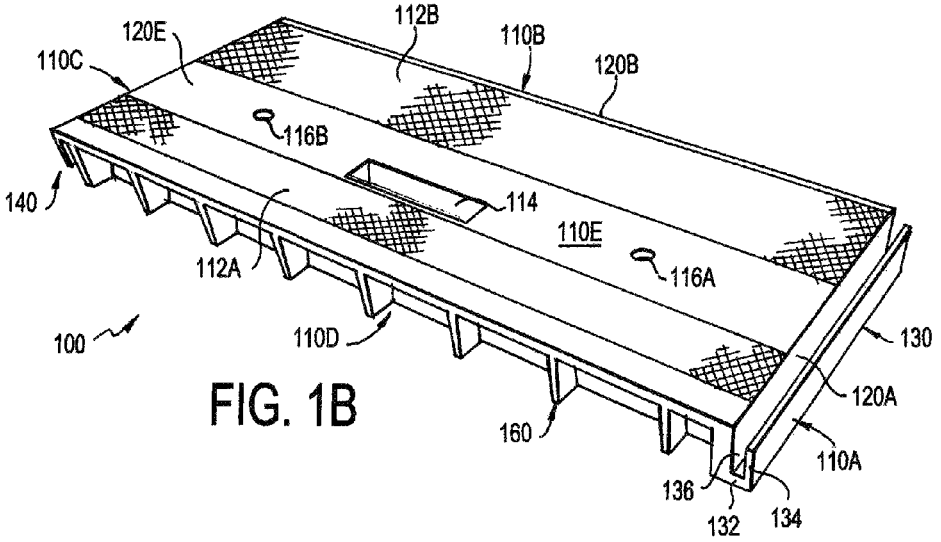
FIG. 1B illustrates a rear, top perspective view of the exemplary embodiment of the temporary tread of FIG. 1A, in accordance with an exemplary embodiment of the present invention.
Figure 1C:
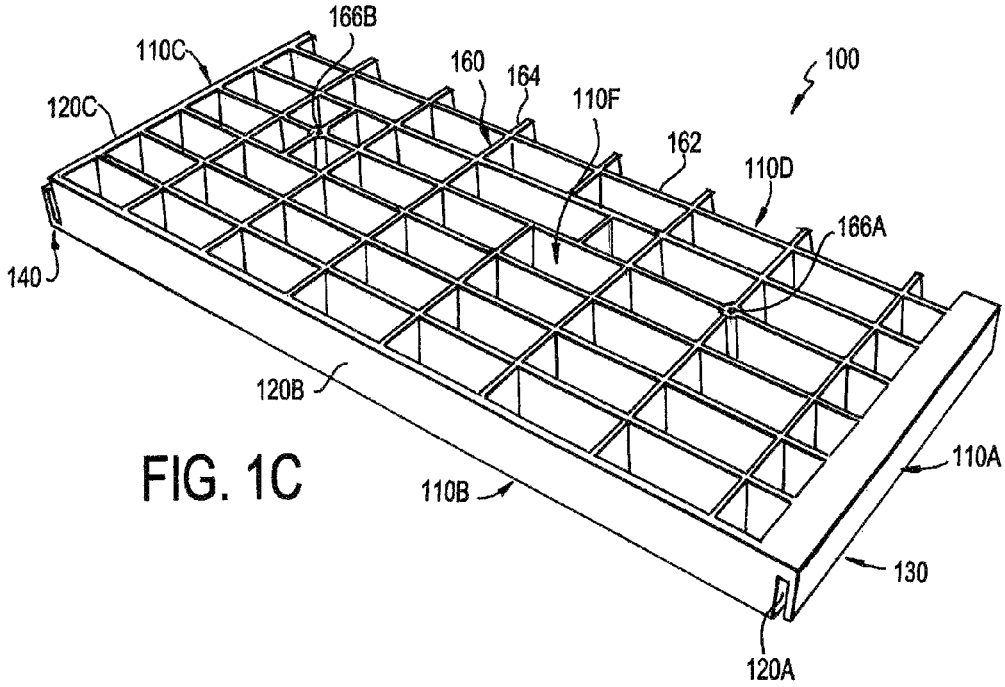
FIG. 1C illustrates a front, bottom perspective view of the exemplary embodiment of the temporary tread of FIG. 1A, in accordance with an exemplary embodiment of the present invention.
Figure 1D:
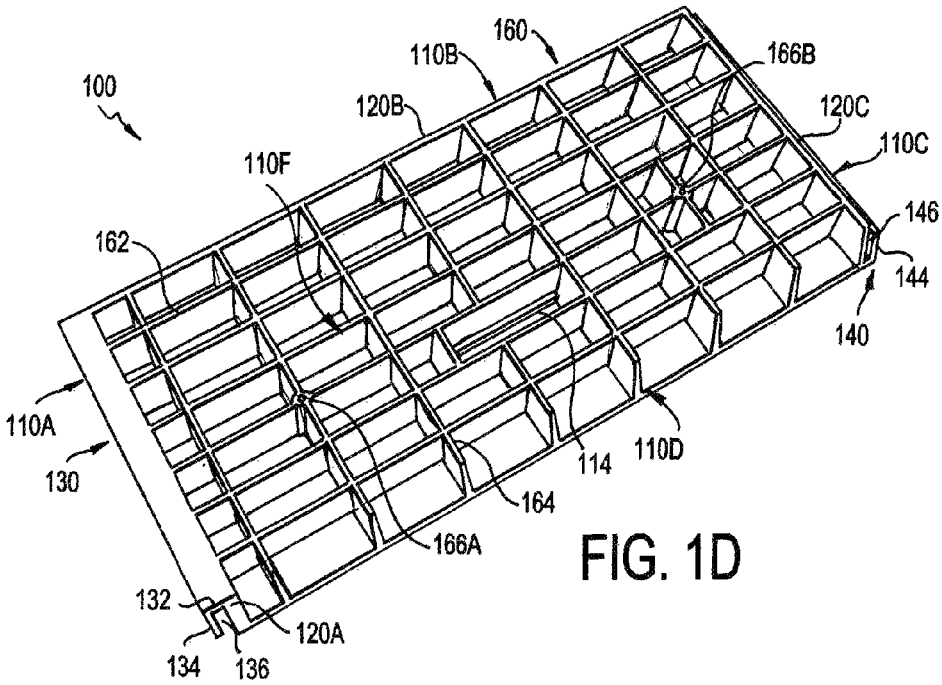
FIG. 1D illustrates a rear, bottom perspective view of the exemplary embodiment of the temporary tread of FIG. 1A, in accordance with an exemplary embodiment of the present invention.

FIG. 1A illustrates a front, top perspective view of a tread, generally designated as 100, for steel-pan stairways, in accordance with an exemplary embodiment of the present invention. FIG. 1B illustrates a rear, top perspective view of the tread 100, in accordance with an exemplary embodiment of the present invention. FIG. 1C illustrates a front, bottom perspective view of the tread 100, in accordance with an exemplary embodiment of the present invention. FIG. 1D illustrates a rear, bottom perspective view of the tread 100, in accordance with an exemplary embodiment of the present invention.

Referring now to FIGS. 1A through 1D, the tread 100 comprises a left side 110A, a front side 110B, a right side 110C, a rear side 110D, a top side 110E, and a bottom side 110F. The tread 100 comprises a left side surface 120A at the left side 110A, a front surface 120B at the front side 110B, a right side surface 120C at the right side 110C, and a top surface 120E at the top side 110E. The surfaces 120A-C, E are planar surfaces or walls. The front surface 120B joins with the top surface 120E at a beveled edge 125.

Disposed on the top surface 120E are first and second non-slip sections 112A and 112B. In one exemplary embodiment, the first and second non-slip sections 112A and 112B are formed from non-slip sheets, such as non-slip grit paper, applied to the top surface 110. In another exemplary embodiment, the first and second non-slip sections 112A and 112B are integrally formed in the top surface 120E. Also disposed in the tread 100 are a hand hole 114 and first and second screw holes 116A and 116B. In an exemplary embodiment, at least a portion of each of the first and second screw holes 116A and 116B is lined with a metal sleeve.

Disposed at the left side 110A is a tongue-in-groove joint 130, and disposed at the right side 110C is a tongue-in-groove joint 140. The tongue-in-groove joint 130 comprises the left side wall 120A, a floor 132 extending from a bottom of the left side wall 120A, and a wall 134 extending upwardly from the floor 132 to form a gap 136 extending from the front side 110B to the rear side 110D of the tread 100. The tongue-in-groove joint 140 comprises the right side wall 120C and a wall 144 extending downwardly from the top surface 120E to form a gap 146 extending from the front side 110B to the rear side 110D of the tread 100.

The tongue-in-groove joint 130 is sized and positioned to connect to a tongue-in-groove joint 140 of another like-constructed tread 100. Specifically, the wall 134 of the tongue-in-groove joint 130 of a first tread 100 is sized to fit within the gap 146 of the tongue-in-groove joint 140 of a second tread 100, and the wall 144 of the second tread 100 is sized to fit within the gap 136 of the first tread 100. The connection of one tongue-in-groove joint 130 to another tongue-in-groove joint 140 allows for the treads 100 to be connected to one another when disposed in a tread or landing pan of a steel-pan stairway. Such connection prevents longitudinal separation of the treads 100 from one another. This provides for added stability of the treads 100.

The bottom side 110F is not formed from a planar surface, as best seen in FIGS. 1C and 1D. Rather, the bottom side 110F is open to an exposed lattice 160 formed as a honeycombed slab comprising lateral members 162 and crosswise members 164. The lateral members 162 and the cross-wise members 164 are formed as a unitary structure with the tongue-in-groove joint 130, the tongue-in-groove joint 140, the front side surface 120B, the top surface 120E, and the bevel 125. In fact, the tread 100 is formed as a unitary structure, excluding the first and second non-slip sections 112A and 112B and sleeves within the first and second screw holes 116A and 116B, in relevant embodiments.

Disposed at an intersection of one of the lateral members 162 and one of the crosswise members 164 is a first thickened portion 166A and at an intersection of another one of the lateral members 162 and another one of the cross-wise members 164 is a second thickened portion 166B. The first screw hole 116A passes through the first thickened portion 166A, and the second screw hole 116B passes through the second thickened portion 166B. The thickened portions 166A and 166B provide structural stability for the screw holes 116A and 116B. Screws may be secured through the screw holes 116A and 116B into a tread or landing pan of a stairway to secure the tread 100 to the tread or landing pan of the stairway.

The lattice 160 is bound on three sides by the left side surface 120A at the left side 110A, the front side surface 120B at the front side 110B, and the right side surface 120C and the right side 110C. The lattice 160 is open at the rear side 110D, as best seen in FIGS. 1B and 1D. The lattice 160 provides for structural stability of the tread 100, while at the same time allowing for the tread 100 to be cut to size in the tread or landing pans of steel-pan stairways to fill gaps. Thus, the tread 100 provides the ability to increase coverage area in the tread and landing pans of steel-pan stairways, thereby providing for more coverage compared to that afforded by the use of building materials to fill the tread and landing pans of steel-pan stairways.

Further, a bottom edge of the exposed lattice 160 (i.e., a bottom edge of the lateral members 162 and the crosswise members 164) forms the bottom side 110F of the tread 100. When the tread 100 is disposed for use in a tread pan or landing pan of a steel-pan stairway, the bottom edge of the exposed lattice 160 abuts (resides on) the tread pan or landing pan. Accordingly, the tread 100 is fully supported across its entire bottom by the tread pan or landing pan. The tread 100 of the present invention does not rely on bridging for support. Therefore, in addition to the stability provided by the tongue-in-groove connection of one tread to another tread when disposed in a tread pan or landing pan, the tread 100 is fully supported and also stabilized by the tread pan or landing pan due to the continual pan contact with the entire bottom edge of the exposed lattice 160.

In an exemplary embodiment, the tread 100 is molded from plastic and has dimensions of 10"×23¾"×2⅛".

Figure 2A:
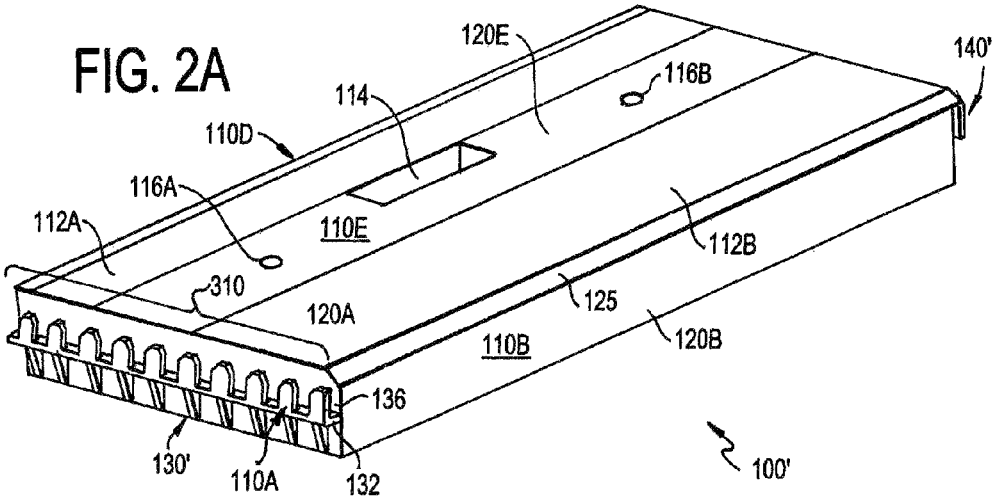
FIG. 2A illustrates a front, top perspective view of another exemplary embodiment of a temporary tread for steel-pan stairways, the view of FIG. 2A showing a left side of the temporary tread, in accordance with an exemplary embodiment of the present invention.
Figure 2B:
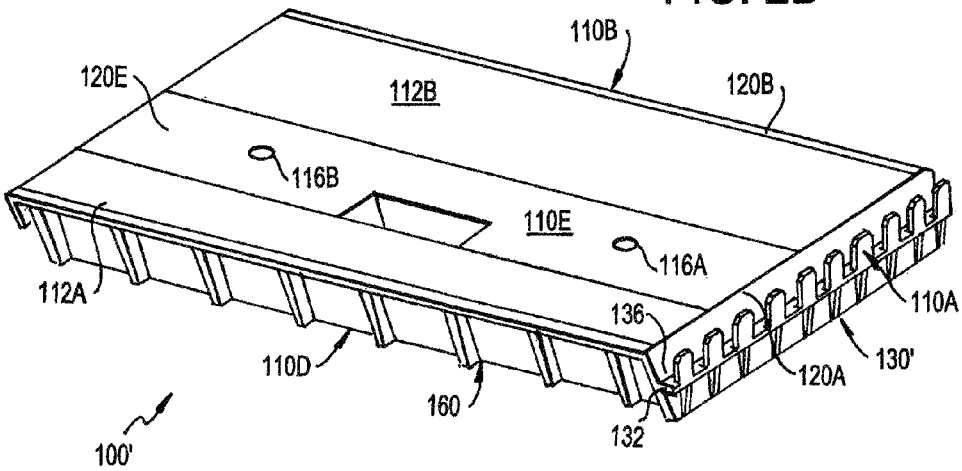
FIG. 2B illustrates a rear, top perspective view of the exemplary embodiment of the temporary tread of FIG. 2A, in accordance with an exemplary embodiment of the present invention.
Figure 2C:
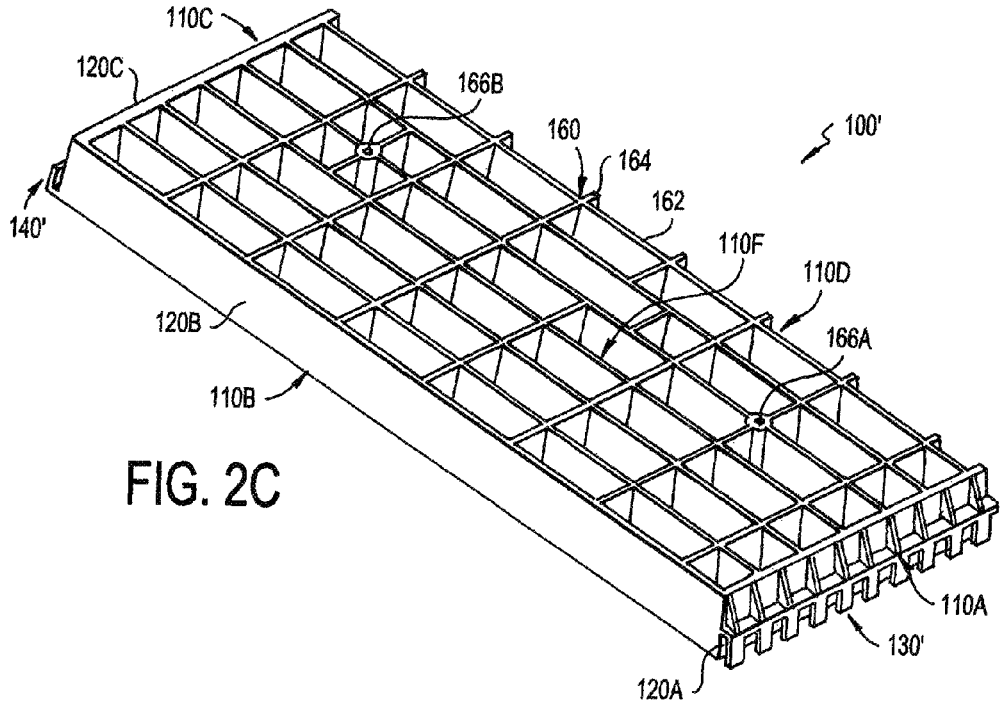
FIG. 2C illustrates a front, bottom perspective view of the exemplary embodiment of the temporary tread of FIG. 2A, in accordance with an exemplary embodiment of the present invention.
Figure 2D:
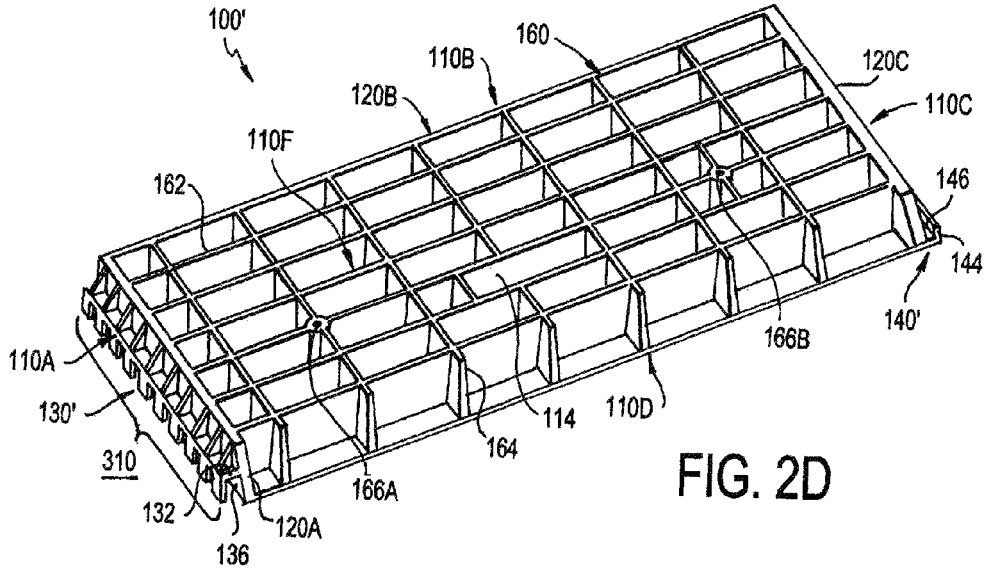
FIG. 2D illustrates a rear, bottom perspective view of the exemplary embodiment of the temporary tread of FIG. 2A, in accordance with an exemplary embodiment of the present invention.

FIG. 2A illustrates a front, top perspective view of an exemplary alternative embodiment of the tread 100, which exemplary alternative embodiment is generally designated as 100' in FIG. 2A, in accordance with an exemplary embodiment of the present invention. FIG. 2B illustrates a rear, top perspective view of the tread 100', in accordance with an exemplary embodiment of the present invention. FIG. 2C illustrates a front, bottom perspective view of the tread 100', in accordance with an exemplary embodiment of the present invention. FIG. 2D illustrates a rear, bottom perspective view of the tread 100', in accordance with an exemplary embodiment of the present invention.

Various components of the tread 100' illustrated in FIGS. 2A-2D are similar to those of the tread 100 illustrated in FIGS. 1A-1D and are indicated with like reference numbers. The tread 100' comprises a tongue-in-groove joint 130' and a tongue-in-groove joint 140' that differ from the tongue-in-groove joint 130 and the tongue-in-groove joint 140 of the tread 100, respectively. Although the tongue-in-groove joint 130' is sized to fit within the tongue-in-groove joint 140' and vice versa, they are formed differently.

Figure 2E:
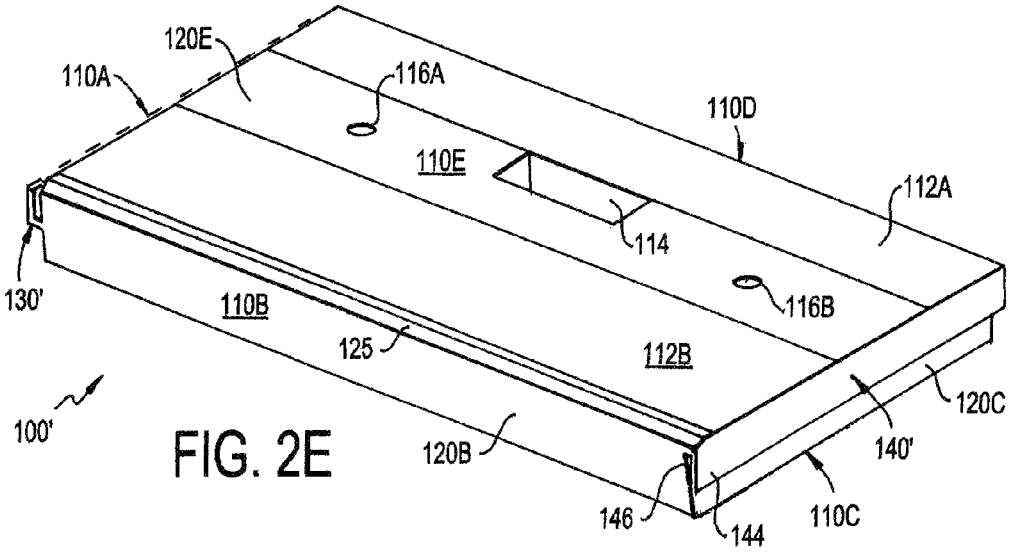
FIG. 2E illustrates another front, top perspective view of the exemplary embodiment of the temporary tread of FIG. 2A, the view of FIG. 2E showing a right side of the temporary tread, in accordance with an exemplary embodiment of the present invention.

FIGS. 2A-2D illustrate the tongue-in-groove joint 130'. Illustrated in FIG. 2E is a front, top perspective view of the tread 100' showing the right side 110C of the tread 100', in accordance with an exemplary embodiment of the present invention. The tongue-in-groove joint 140' is seen in the view illustrated in FIG. 2E.

Figure 3:
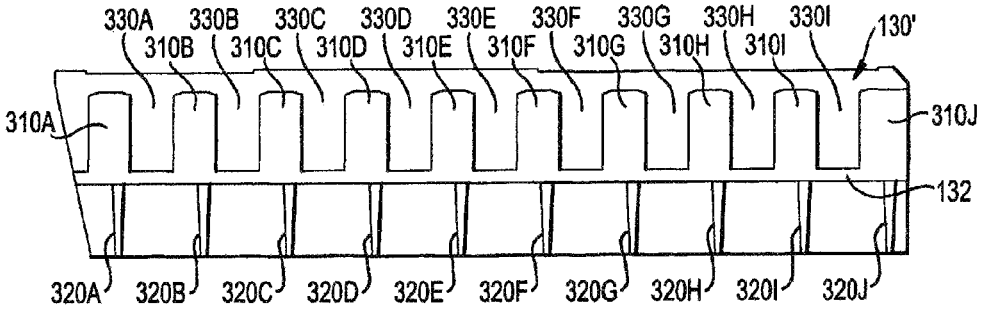
FIG. 3 illustrates a left side view of the exemplary embodiment of the temporary tread of FIG. 2A, in accordance with an exemplary embodiment of the present invention.

Referring now to FIG. 3, there is illustrated a view of the left side 110A of the tread 100', in accordance with an exemplary embodiment of the present invention. As seen in this view, the tongue-in-groove joint 130' is attached to the left wall 120A of the tread 100'. The tongue-in-groove joint 130' comprises a plurality of teeth 310A through 310J that extend upwardly from the shelf 132 that extends outwardly from a middle of the left wall 120A. Associated with the plurality of teeth 310A-J is a plurality of braces 320A through 320J. The braces 320A-J extend from the bottom surface of the shelf 132 and taper inwardly toward the left wall 120A. The braces 320A-J support the shelf 132 and the teeth 310A-J that extend upwardly from the top surface of the shelf 132. The teeth 310A-J are separated from one another by a plurality of respective gaps 330A through 330I.

Figure 4A:
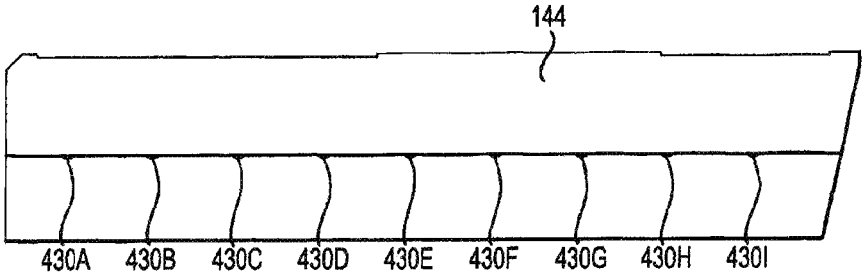
FIG. 4A illustrates a right side view of the exemplary embodiment of the temporary tread of FIG. 2A, in accordance with an exemplary embodiment of the present invention.

Referring now to FIG. 4A, there is illustrated a view of the right side 110C of the tread 100', in accordance with an exemplary embodiment of the present invention. As seen in this view, the tongue-in-groove joint 140' is attached to the left wall 120C of the tread 100'. The tongue-in-groove joint 140' comprises the wall 144 that descends from the top surface 110. In this sense, the tongue-in-groove joint 140' is similar to the tongue-in-groove joint 140.

Figure 4B:
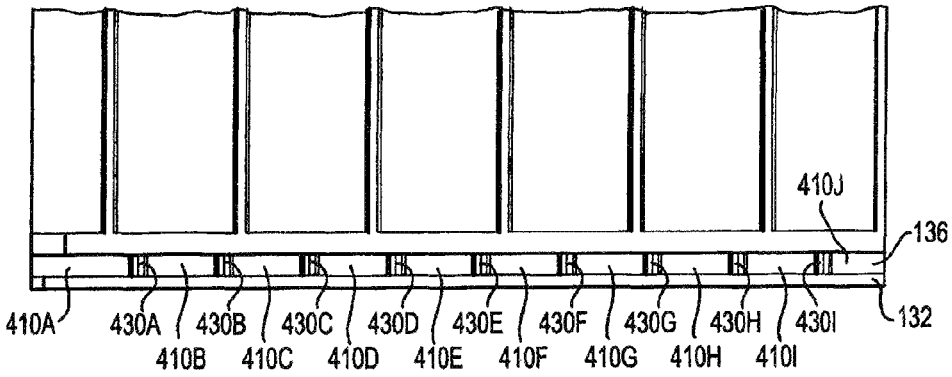
FIG. 4B illustrates a detailed view of the right side of the temporary tread of FIG. 2A, in accordance with an exemplary embodiment of the present invention.

Illustrated in FIG. 4B is a close-up view of an area of the bottom side 110F of the tread 100', in accordance with an exemplary embodiment of the present invention. In this view it is seen that the tongue-in-groove joint 140' differs from the tongue-in-groove joint 140 in that it further comprises a plurality of bridges 430A through 430I which connect the wall 144 to the right wall 120C. The bridges 430A-I form a plurality of respective pockets 410A through 410J which respectively correspond to the teeth 310A-J of the tongue-in-groove joint 130'. The bridges 430A-I correspond to the gaps 330A-I of the tongue-in-groove joint 130'.

When a first tread 100' is connected to a second tread 100' via the tongue-in-groove joints 130' and 140', the teeth 310A-J of one of the treads 100' are disposed within the pockets 410A-J of the other of the treads 100' and the bridges 430A-I of the other of the treads 100' are disposed in the gaps 330A-I of the one of the treads 100'. Such arrangement prevents longitudinal separation of the one tread 100' from the other tread 100'. It also prevents separation of the treads 100' via lateral displacement of the treads 100' relative to one another, unlike the tongue-in-groove joints 130, 140 of the tread 100. Thus, the treads 100' have increased stability when connected to one another.

Figure 5:
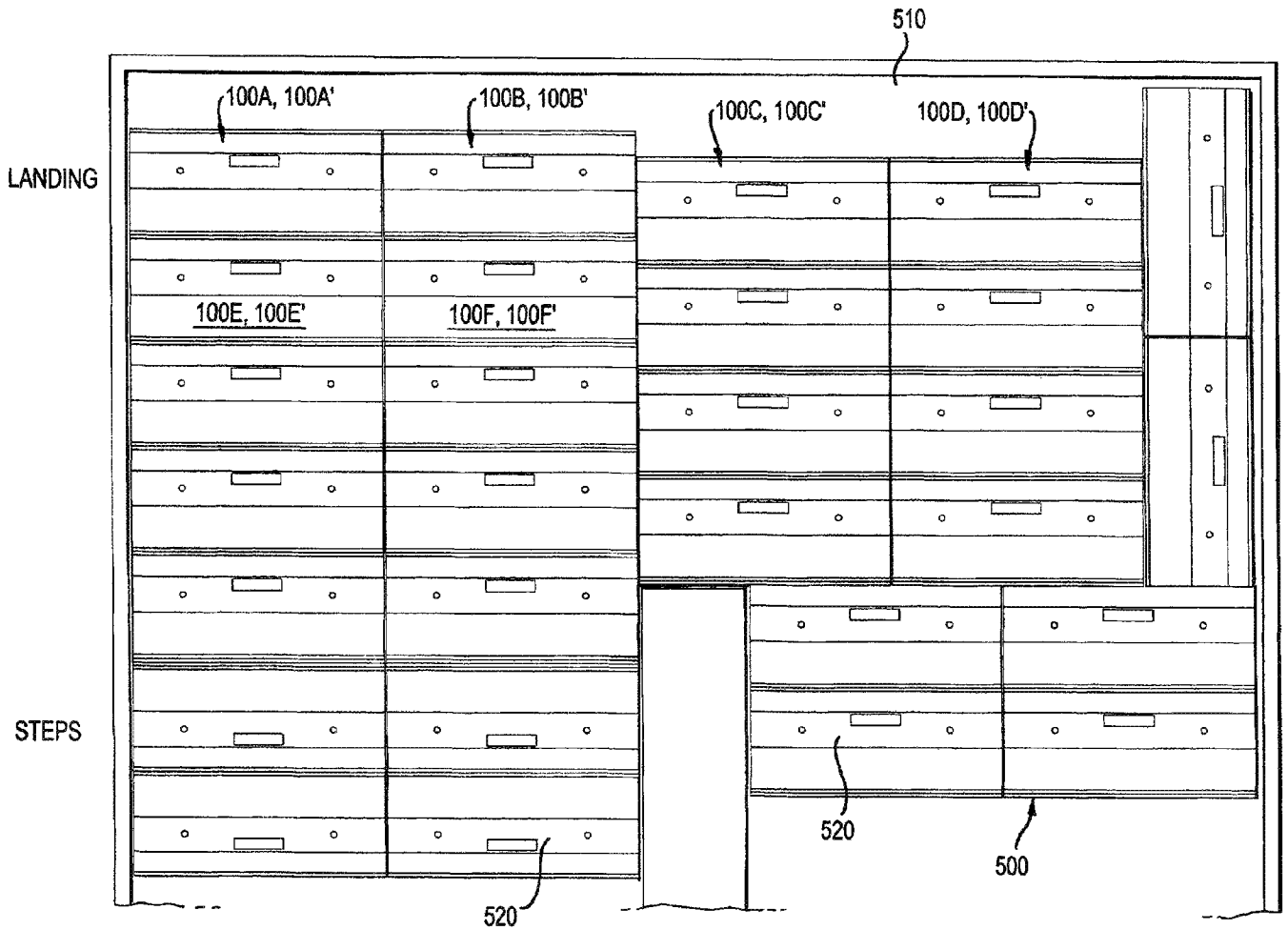
FIG. 5 illustrates a stairwell on which a plurality of the temporary treads of FIG. 1A or FIG. 2A are disposed, in accordance with an exemplary embodiment of the present invention.

Referring now to FIG. 5, there is illustrated a stairwell, generally designated as 500, in accordance with an exemplary embodiment of the present invention. The stairwell 500 comprises a landing pan 510 and tread pans 520 in which treads 100, 100' are disposed temporarily. For purposes of illustration, only a few of the treads 100, 100' in FIG. 5 are labeled. These are labeled as treads 100A-100F and 100A'-100F' in the landing pan 510. The tread 100A, 100A' is connected to the tread 100B, 100B; the tread 100B, 100B' is connected to the tread 100C, 100C; and the tread 100C, 100C' is connected to the tread 100D, 100D'. The tread 100E, 100E' is connected to the tread 100F, 100F', and the tread 100F, 100F' is connected to the tread 100C, 100C'. The tread 100A, 100A' is not connected directly to the tread 100E, 100E' because a tread 100, 100' does not have a tongue-in-groove joint on the front or rear sides 120B, 120D.

Although the treads 100, 100' are described as being temporarily disposed in the landing pan 510 and the tread pans 520 of the stairway 500, other embodiments in which the treads 100, 100' are permanently installed are contemplated. Accordingly, it is contemplated that the treads 100, 100' may be used as temporary treads for tread and landing pans of a stairway or that they may be used as permanent treads for tread and landing pans of a stairway. Any materials capable for use of the treads 100, 100' are contemplated. Exemplary materials include synthetic polymer, including, but not limited to, polyvinyl chloride, polystyrene, polyethylene, polypropylene, polyacrylonitrile, and others.

Figure 6:
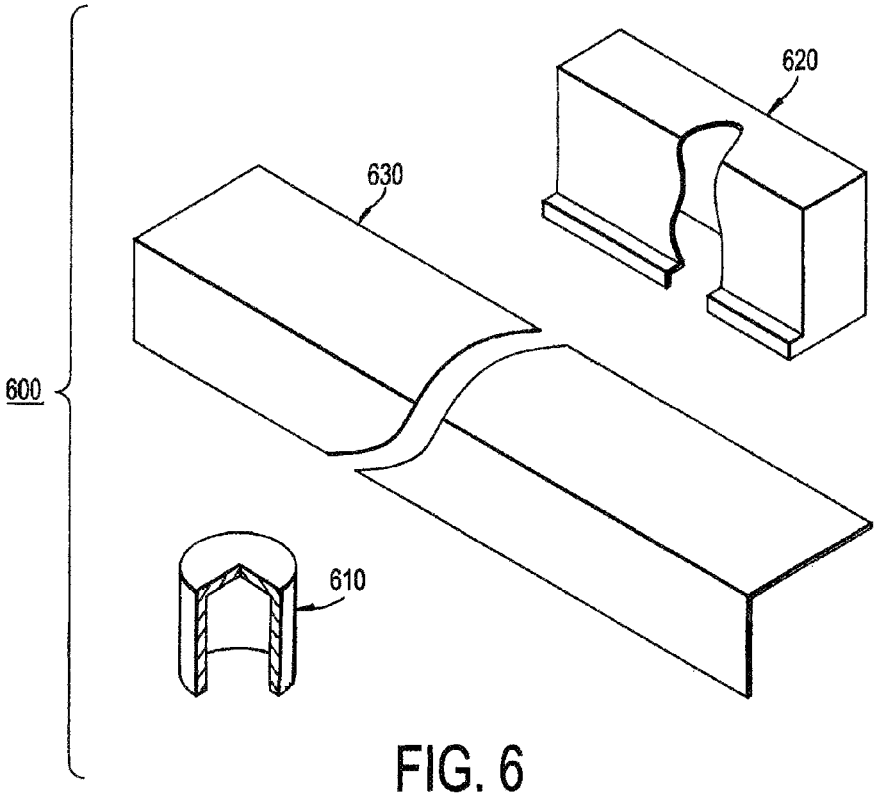
FIG. 6 illustrates an exemplary kit for use in temporary tread placement in a stairwell, the kit including at least one tread, and one or more of a pair of screw hole plugs, a hand hole plug and an edge frame filler.

In an exemplary embodiment, the treads 100, 100' may be provided as part of a kit 600, as illustrated in FIG. 6, in accordance with an exemplary embodiment of the present invention. The kit 600 may comprise at least one of the treads 100, 100', a pair of screw hole plugs 610 for plugging the screw holes 116A, 116B, a hand hole plug 620 for plugging the hand hole 114, and one or more edge frame fillers 630 for placement around the edges of the treads 100, 100' when installed in the landing pans 510 or tread pans 520 of the stairwell 500. The edge frame fillers 630 fill any gaps that may exist between the treads 100, 100' and the sides of the landing pans 510 or tread pans 520.

These and other advantages of the present invention will be apparent to those skilled in the art from the foregoing specification. Accordingly, it is to be recognized by those skilled in the art that changes or modifications may be made to the above-described embodiments without departing from the broad inventive concepts of the invention. It is to be understood that this invention is not limited to the particular embodiments described herein, but is intended to include all changes and modifications that are within the scope and spirit of the invention.

What is claimed is:

1. A tread for a steel-pan staircase comprising:

a lattice structure comprising a plurality of longitudinal members and a plurality of crosswise members, the lattice structure further comprising a front side, a rear side, a top side, a bottom side, a left side, and a right side, wherein the longitudinal members extend from the left side to the right side, parallel to a longitudinal axis of the tread, and the crosswise members extend from the front side to the rear side, perpendicular to the longitudinal axis of the tread;

a planar top surface integrally formed on the top side of the lattice structure, the planar top surface covering the plurality of longitudinal members and the plurality of crosswise members; and two tongue-and-groove structures, one disposed on the left side, and one disposed on the right side, of the lattice structure, wherein each tongue-and-groove structure comprises only one tongue and only one groove, where one tongue-and-groove structure extends along an entirety of the left side, from the front side to the rear side, and one tongue-and-groove structure extends along an entirety of the right side, from the front side to the rear side, and where one tongue-and-groove structure has a groove open to a top of the tread and one tongue-and-groove structure has a groove open to a bottom of the tread;

whereby each tongue-and-groove structure facilitates a joining of the tread to an other, similar tread, and prevents a longitudinal separation of the tread from the other, similar tread.

2. The tread of claim 1, wherein the only one tongue and the only one groove of each of the two tongue-and-groove structures is disposed parallel to the crosswise members.

3. The tread of claim 1, further comprising a planar front surface integrally formed on the front side of the lattice structure, the planar front surface covering the plurality of crosswise members.

4. The tread of claim 3, further comprising a bevel where the front surface and the top surface meet.

5. The tread of claim 1, wherein the top surface comprises a rectangular hand hole, wherein the hand hold resides between two longitudinal members and extends from the top surface to the bottom side, the hand hole including a shelf along at least one of the longitudinal members, below the top surface, the tread further comprising a hand hold plug including a mating shelf along at least longitudinal side thereof to engage the shelf of the hand hole, wherein the hand hole plug resides within and fills the hand hole to a level of the top surface.

6. The tread of claim 1, wherein the lattice structure further comprises a first thickened portion at an intersection of a first of the plurality of longitudinal members and a first of the plurality of crosswise members and a second thickened portion at an intersection of a second of the plurality of longitudinal members and a second of the plurality of crosswise members, the tread further comprising a first screw hole passing through the top surface and the first thickened portion and a second screw hole passing through the top surface and the second thickened portion.

7. The tread of claim 1, wherein each tongue-and-groove structure includes a floor extending longitudinally from, and perpendicularly to, the left side or the right side, and a wall extending perpendicularly from the floor, parallel to the left side or the right side, the floor defining a gap between the wall and the left side or the right side, the wall being the tongue and the gap being the groove of each tongue-and-groove structure.

8. The tread of claim 7, wherein, in one tongue-and-groove structure the floor extends longitudinally from, and perpendicularly to, the left side or the right side in a plane of the bottom side of the tread, and in one tongue-and-groove structure the floor extends longitudinally from, and perpendicularly to, the left side or the right side in a plane of the top surface of the tread.

9. A kit for permanent use in a steel-pan staircase of the tread of claim 1, the kit comprising;

one or more treads, each tread in accordance with claim 1;

a set of screw hole plugs for each tread, the screw hole plugs fill each screw hole contained in each tread to a level of the top surface;

a hand hold plug for each tread, the hand hold plugs fill each hand hold contained in each tread to a level of the top surface; and one or more edge frame fillers, the edge frame fillers filling any gaps between the one or more treads and a side of a landing pan or tread pan in a stairwell or landing, the one or more edge frame fillers configured to fill any gap to a level of the top surface.

10. A tread for a steel-pan staircase comprising:

a lattice structure comprising a plurality of longitudinal members and a plurality of crosswise members, the lattice structure further comprising a front side, a rear side, a top side, a bottom side, a left side, and a right side, wherein the longitudinal members extend from the left side to the right side, parallel to a longitudinal axis of the tread, and the crosswise members extend from the front side to the rear side, perpendicular to the longitudinal axis of the tread;

a planar top surface integrally formed on the top side of the lattice structure, the planar top surface covering the plurality of longitudinal members and the plurality of crosswise members;

a planar right side surface integrally formed on the right side of the lattice structure, the planar right side surface covering the plurality of longitudinal members;

a planar left side surface integrally formed on the left side of the lattice structure, the planar left side surface covering the plurality of longitudinal members; and two tongue-and-groove structures, one disposed on the left side, and one disposed on the right side, of the lattice structure, wherein:

a first tongue-and-groove structure comprises only one tongue and only one groove, the first tongue-and-groove structure extending parallel to, and along an entirety of, the planar left side surface or the planar right side surface, from the front side to the rear side;

a second tongue-and-groove structure comprises only one groove and a tongue comprising multiple teeth residing in a single plane, each of the multiple teeth having a space therebetween, the second tongue-and-groove structure extending parallel to, and along an entirety of, the planar right side surface, from the front side to the rear side, the only one groove of either the first or the second tongue-and-groove structure is open to a top of the tread and the only one groove of the other of the first or the second tongue-and-groove structure is open to a bottom of the tread;

whereby each tongue-and-groove structure facilitates a joining of the tread to an other, similar tread, and prevents a longitudinal separation of the tread from the other, similar tread.

11. The tread of claim 10, wherein each tongue-and-groove structure includes a floor extending longitudinally from, and perpendicularly to, the planar left side surface or the planar right side surface, and includes a wall extending perpendicularly from the floor, parallel to the planar left side surface or the planar right side surface, the floor defining a gap between the wall and the planar left side surface or the planar right side surface, the wall being the respective tongue and the gap being the respective groove of each tongue-and-groove structure.

12. The tread of claim 11, wherein the first tongue-and-groove structure further includes multiple bridges extending across the gap, connecting the wall to the planar left side surface or the planar right side surface, the multiple bridges residing in a single plane between planes defined by the top side and by the bottom side, the multiple bridges spaced apart with pockets therebetween, wherein a joining of the teeth of the second tongue-and-groove structure into pockets of, and between bridges of, a first tongue-in-groove structure of an other, similar tread, prevents a longitudinal separation of the tread from the other, similar tread, and also prevents lateral displacement of the tread relative to the other, similar tread.

13. The tread of claim 12, further comprising a plurality of braces, each brace supporting the floor of the second tongue-and-groove structure, each of the plurality of braces spanning between an underside of the floor and an outside of the planar left side surface or the planar right side surface.

14. The tread of claim 10, further comprising a planar front surface integrally formed on the front side of the lattice structure, the planar front surface covering the plurality of crosswise members.

15. The tread of claim 14, further comprising a bevel where the front surface and the top surface meet.

16. The tread of claim 14, wherein the top surface comprises a rectangular hand hole, wherein the hand hold resides between two longitudinal members and extends from the top surface to the bottom side, the hand hole including a shelf along at least one of the longitudinal members, below the top surface, the tread further comprising a hand hold plug including a mating shelf along at least longitudinal side thereof to engage the shelf of the hand hole, wherein the hand hole plug resides within and fills the hand hole to a level of the top surface.

17. A kit for permanent use in a steel-pan staircase of the tread of claim 10, the kit comprising;

one or more treads, each tread in accordance with claim 10;

a set of screw hole plugs for each tread, the screw hole plugs fill each screw hole contained in each tread to a level of the top surface;

a hand hold plug for each tread, the hand hold plugs fill each hand hold contained in each tread to a level of the top surface; and one or more edge frame fillers, the edge frame fillers filling any gaps between the one or more treads and a side of a landing pan or tread pan in a stairwell or landing, the one or more edge frame fillers configured to fill any gap to a level of the top surface.

* * * * *